US011827440B2

(12) United States Patent
Welle

(10) Patent No.: US 11,827,440 B2
(45) **Date of Patent: *Nov. 28, 2023**

(54) THERMALLY INSULATING HOLDER FOR DISPOSABLE BEVERAGE CUPS

(71) Applicant: Richard Patrick Welle, Sunset Beach, CA (US)

(72) Inventor: Richard Patrick Welle, Sunset Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/697,785

(22) Filed: Mar. 17, 2022

(65) Prior Publication Data

US 2022/0274767 A1 Sep. 1, 2022

Related U.S. Application Data

(63) Continuation-in-part of application No. 17/541,613, filed on Dec. 3, 2021, which is a continuation of application No. 17/214,814, filed on Mar. 27, 2021, now Pat. No. 11,225,369.

(60) Provisional application No. 63/011,780, filed on Apr. 17, 2020.

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01); *A47G 2023/0283* (2013.01); *B65D 2543/00046* (2013.01)

(58) Field of Classification Search
CPC ..... B65D 81/3876; B65D 81/3879; B65D 81/3881; B65D 81/3886; A47G 23/02; A47G 23/0208; A47G 23/0216; A47G 23/0266; A47G 23/04; A47G 2023/0275; A47G 2023/0283; A47G 2023/0291
See application file for complete search history.

(56) References Cited

U.S. PATENT DOCUMENTS 3,766,975 A 10/1973 Todd
4,163,374 A 8/1979 Moore et al.
4,666,068 A * 5/1987 Bush ..... B65D 47/0885 D9/446
4,798,063 A 1/1989 Rimmer
(Continued)

FOREIGN PATENT DOCUMENTS

EP 3733546 11/2020

OTHER PUBLICATIONS

International Search Report and Written Opinion for PCT/US21/26526 dated Aug. 5, 2021; 16 pages.
(Continued)

*Primary Examiner* — Javier A Pagan
(74) *Attorney, Agent, or Firm* — Snell & Wilmer, L.L.P.; Jaime D. Choi

(57) ABSTRACT

An assembly for holding a beverage cup is provided herein. The assembly may include a cup holder and a retainer. The cup holder may include a closed bottom, a generally cylindrical or frustoconical side wall, and an upper access opening configured to receive the beverage cup. An outer surface of the side wall of the cup holder may include a latch-engagement feature. The retainer may include a retaining ring, a skirt, a latch, and a hinge. The latch is configured to engage the latch-engagement feature.

6 Claims, 11 Drawing Sheets

(56) References Cited

U.S. PATENT DOCUMENTS

| | | | | |
|---|---|---|---|---|
| 4,974,741 | A * | 12/1990 | Gustafson | B65D 81/3886 D7/511 |
| 5,022,235 | A * | 6/1991 | Grissom | F25D 3/08 62/530 |
| 5,040,719 | A | 8/1991 | Ballway | |
| 5,820,016 | A | 10/1998 | Stropkay | |
| 5,839,596 | A | 11/1998 | Zahn | |
| 6,367,652 | B1 | 4/2002 | Toida | |
| 7,686,183 | B2 | 3/2010 | Ziegler | |
| 7,922,031 | B1 | 4/2011 | Prince | |
| RE42,421 | E | 6/2011 | Toida | |
| 8,276,776 | B2 | 10/2012 | Roth | |
| 8,336,732 | B1 | 12/2012 | Tobias | |
| 8,668,106 | B1 | 3/2014 | Joy et al. | |
| 9,108,776 | B2 | 8/2015 | Smyers | |
| 9,655,463 | B2 | 5/2017 | Madala | |
| 9,988,202 | B2 | 6/2018 | Haas | |
| 10,005,608 | B1 | 6/2018 | Jacob | |
| D830,788 | S | 10/2018 | Petrillo | |
| 10,093,462 | B2 | 10/2018 | McArthur | |
| 10,173,872 | B2 | 1/2019 | Foote | |
| 10,279,721 | B1 | 5/2019 | Nelson | |
| 10,441,102 | B1 | 10/2019 | Bunting | |
| 10,457,471 | B2 * | 10/2019 | Jacob | A47J 41/0038 |
| 10,494,156 | B2 | 12/2019 | Alvarez | |
| 10,595,653 | B1 | 3/2020 | Messilaty | |
| 10,624,477 | B1 | 4/2020 | Messilaty | |
| 10,703,553 | B2 | 7/2020 | Haas | |
| 10,787,304 | B2 | 9/2020 | Haas | |
| 10,888,185 | B2 | 1/2021 | Messilaty | |
| 10,974,889 | B2 * | 4/2021 | Callinan | B65D 81/3886 |
| 11,225,369 | B2 * | 1/2022 | Welle | B65D 81/3883 |
| 2002/0088810 | A1 | 7/2002 | Murakami | |
| 2009/0107947 | A1 | 4/2009 | Knaack | |
| 2015/0122828 | A1 * | 5/2015 | Madala | A47G 23/0266 220/592.17 |
| 2016/0022074 | A1 * | 1/2016 | Martin | A47G 23/0266 29/525 |
| 2017/0119186 | A1 | 5/2017 | Rivera | |
| 2020/0339313 | A1 | 10/2020 | DiDato | |

OTHER PUBLICATIONS

Notice of Allowance dated Sep. 22, 2021 in U.S. Appl. No. 17/214,814; 12 pages.

Non-Final Office Action dated Jun. 15, 2021 in U.S. Appl. No. 17/214,814; 9 pages.

Non-Final Office Action dated May 16, 2022 in U.S. Appl. No. 17/541,613; 16 pages.

Final Office Action dated Feb. 6, 2023 in U.S. Appl. No. 17/541,613; 20 pages.

Advisory Action dated Apr. 14, 2023 in U.S. Appl. No. 17/541,613; 3 pages.

Final Office Action dated May 1, 2023 in U.S. Appl. No. 17/541,613; 11 pages.

* cited by examiner

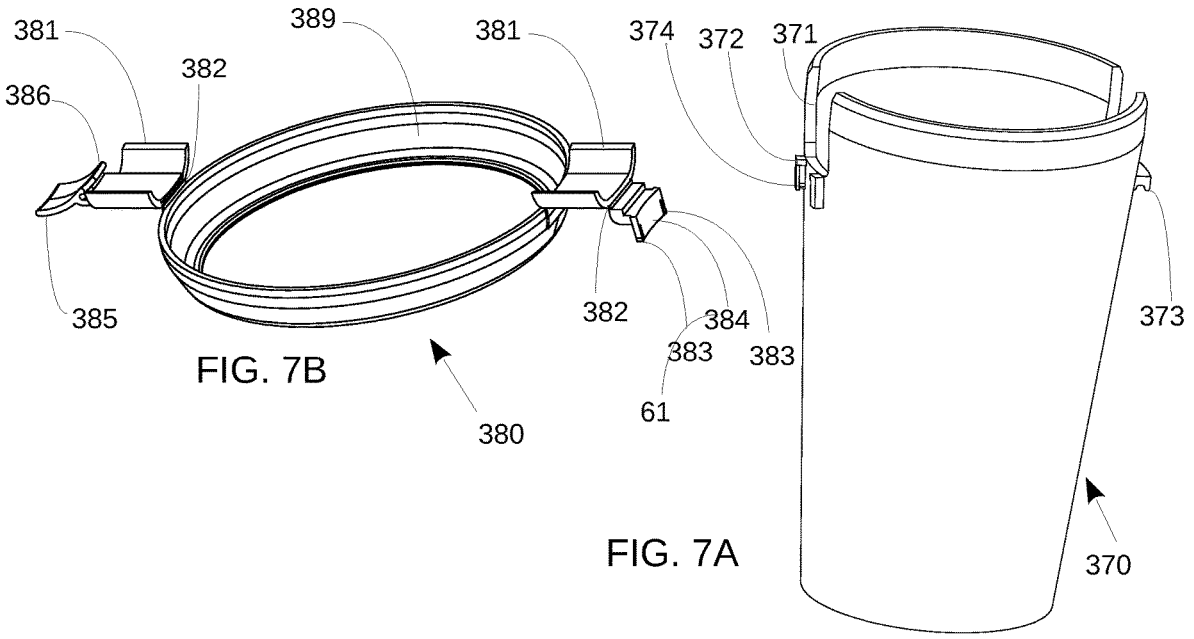
FIG. 7B
FIG. 7A
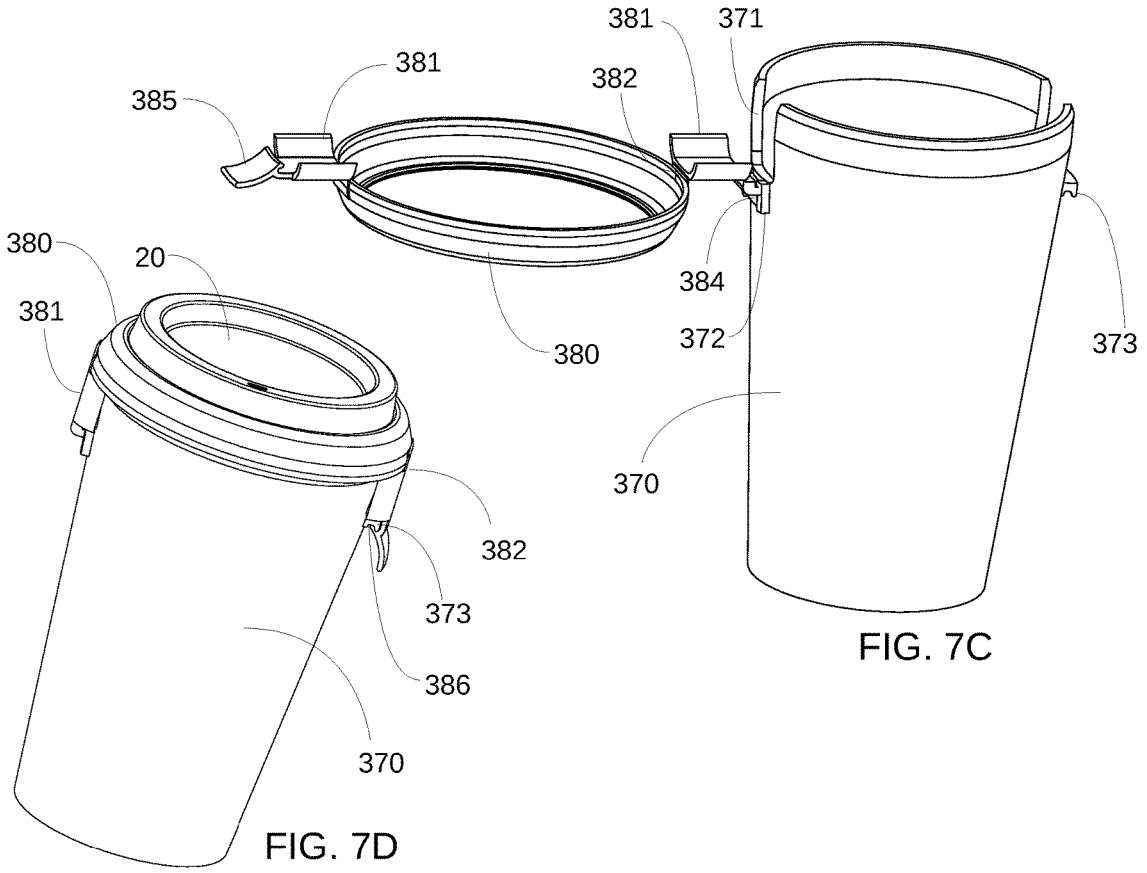
FIG. 7C
FIG. 7D

THERMALLY INSULATING HOLDER FOR DISPOSABLE BEVERAGE CUPS

CROSS-REFERENCE TO RELATED APPLICATIONS

This application is a continuation-in-part under 35 U.S.C. § 120 of U.S. patent application Ser. No. 17/541,613, filed on Dec. 3, 2021, which is a continuation under 35 U.S.C. § 120 of U.S. patent application Ser. No. 17/214,814, filed on Mar. 27, 2021, now U.S. Pat. No. 11,225,369, which claims the benefit of U.S. Provisional Patent Application No. 63/011,780, filed Apr. 17, 2020, the entire contents of each of which applications is incorporated by reference herein.

FIELD

The present application relates to cup holders, and more specifically, to insulating cup holders for disposable beverage cups.

BACKGROUND OF THE INVENTION

Reusable insulating beverage containers, often called travel mugs, are vessels that include inner and outer shells separated from one another by a vacuum or other insulating space. An opening at the top allows beverages to be introduced into the inner shell and consumed therefrom. The top opening is often provided with a secure lid that can be closed to prevent accidental spillage of the beverage during handling and transport of the mug. The insulating quality of such travel mugs ensures that a beverage introduced into the inner shell can maintain a temperature, whether hot or cold, substantially different from the temperature of the surrounding environment for an extended period of time in comparison to uninsulated beverage containers.

While such travel mugs can be conveniently filled with beverages in a home setting, their utility for beverages sold over the counter, such as specialty coffees, is limited because vendors of such beverages are often not willing to dispense such beverages directly into personal travel mugs. Indeed, vendors may be prohibited by regulation from dispensing directly into such travel mugs for health reasons. Furthermore, when a travel mug is used, it is often preferable to clean the mug before reuse, which may not be convenient for travel mugs kept, for example, in automobiles for beverage consumption while driving.

Over-the-counter beverages, such as specialty coffees, are typically sold in uninsulated disposable plastic or paper cups, which are often provided with disposable lids to prevent spillage. It is known, however, that such lids can be unreliable because the fit between the lid and the cup, typically a snap fit between a radially-outward-extending peripheral bead on the cup and a corresponding recess in the lid, depends on consistent manufacture and consistent application by the beverage vendor after the cup is filled. If the lid is not properly attached to the cup it can leak or become dislodged, resulting in spillage of the beverage.

Toida et al. (U.S. Pat. No. 6,367,652) disclosed an insulating cup holder into which a disposable beverage cup can be inserted, thereby providing the thermal insulating capability of a travel mug for use with a disposable beverage cup. However, the cup holder disclosed by Toida et al. included an unbroken upward-facing flange on the side wall to support the cup through contact with the underside of the peripheral bead on the cup. In this configuration, it is not possible for the user's fingers to remain in contact with the outside of the disposable cup, except with the peripheral bead if the disposable lid is not yet attached, while the cup is being fully inserted into the cup holder. As such, if the lid is attached, it would be necessary to hold the cup by the lid for insertion into the insulating holder, posing a risk that the lid would come off during the insertion process, thereby potentially spilling the beverage if the cup is filled with a beverage at the time it is inserted into the cup holder. Alternatively, if the lid is not yet attached, it would be necessary to hold the cup by the bead as it is inserted. This may be problematic since the bead is typically not large enough to provide a reliable hold on the cup, again posing a risk of spilling the beverage. Furthermore, the design of Toida et al. did not include provisions for securing the lid or cup in place once the cup was inserted into the holder.

The present application is directed to overcoming one or more of the above deficiencies in the prior art.

BRIEF SUMMARY

Some examples herein provide an improved holder for a disposable beverage cup. Some examples herein provide an insulated holder for a disposable beverage cup. Some examples herein provide a holder for a disposable beverage cup wherein the disposable beverage cup can be manually inserted fully into the holder while maintaining contact with the outer surface of the cup. Some examples herein provide a holder for a disposable beverage cup wherein the disposable beverage cup and lid can be secured within the cup holder.

Illustratively, an insulating holder is provided herein that is configured to securely contain a disposable beverage cup while limiting the flow of heat to or from the contents of the cup. Disposable beverage cups typically have an inverted frustoconical side wall, a closed bottom, and an upper opening surrounded by a radially-outwardly-extending peripheral bead sized to be mated with a corresponding peripheral groove in a disposable lid by means of a snap fit. The insulating holder of the present disclosure may be or include a vessel with insulating walls having an upper access opening shaped to receive the disposable beverage cup, with the top edge of the holder side wall abutting the bottom of the peripheral bead.

In some examples, a cup holder includes an insulating vessel for accepting a disposable beverage cup and a retaining mechanism for securely holding the cup and lid in the holder when in use.

In some examples, the side wall of the cup holder includes two or more gaps sized to allow the cup to be held by the side wall below the lid with two or more fingers while inserting the cup into the holder.

In some examples, the retaining mechanism is secured by means of a snap fit.

In some examples, the retaining mechanism is configured to cover the two or more gaps when the retaining mechanism is secured to the insulating cup holder.

In some examples, the retaining mechanism is semi-permanently attached to the cup holder and hinged to allow it to rotate and allow insertion or removal of a cup from the cup holder.

In some examples, the retaining mechanism includes a modified disposable lid.

In some examples, the holder is a double-walled vessel with an evacuated gap between the walls to reduce or minimize heat flow.

Some examples herein provide an assembly for holding a beverage cup. The assembly may include a cup holder including a closed bottom, a generally cylindrical or frustoconical side wall, and an upper access opening configured to receive the beverage cup. An outer surface of the side wall of the cup holder includes a latch-engagement feature. The assembly also may include a retainer including a retaining ring, a skirt, a latch, and a hinge. The latch is configured to engage the latch-engagement feature.

In some examples, the side wall of the cup holder includes an upward facing flange configured to support the peripheral bead. In some examples, the side wall and the flange of the cup holder include two or more gaps sized to allow a user to hold a beverage cup with two or more fingers while inserting the beverage cup into the cup holder. In some examples, the skirt covers the two or more gaps.

Some examples herein provide an assembly for holding a beverage cup. The assembly includes a cup holder including a closed bottom, a generally cylindrical or frustoconical side wall, and an upper access opening configured to receive the beverage cup. An outer surface of the side wall of the cup holder includes at least one latch-engagement feature. The assembly also includes a retainer including a retaining ring, a skirt, first and second latches, and first and second hinges respectively movably coupling the first and second latches to the skirt. The retainer is couplable to the cup holder by engaging the first and second latches with the latch-engagement feature and is removable from the cup holder by disengaging the first and second latches from the latch-engagement feature.

In some examples, the at least one latch-engagement feature includes at least one recess. In some examples, the at least one recess is downward-facing. In some examples, the first and second latches include first and second latch hooks that respectively insert into the at least one recess.

In some examples, the at least one latch-engagement feature encircles the cup holder and defines a single recess with which the first and second latches both engage. In some examples, the at least one latch-engagement feature is segmented and defines first and second recesses with which the first and second latches respectively engage.

In some examples, the side wall of the cup holder includes first and second gaps sized to allow a user to hold the beverage cup with first and second fingers while inserting the beverage cup into the cup holder. In some examples, the first and second latches respectively cover the first and second gaps when the retainer is coupled to the cup holder. In some examples, the skirt includes first and second skirt extensions that respectively cover the first and second gaps when the retainer is coupled to the cup holder. In some examples, the side wall of the cup holder further includes a third gap sized to allow a user to further hold the beverage cup with a third finger while inserting the beverage cup into the cup holder. In some examples, the first gap is larger than the second gap.

In some examples, the first and second hinges include living hinges.

Some examples herein provide a cup holder for holding a beverage cup. The cup holder includes a closed bottom; a generally cylindrical or frustoconical side wall; and an upper access opening configured to receive the beverage cup. An outer surface of the side wall of the cup holder includes at least one latch-engagement feature configured to engage first and second latches of a retainer.

In some examples, the at least one latch-engagement feature includes at least one recess. In some examples, the at least one recess is downward-facing. In some examples, the at least one recess is configured to having inserted therein first and second latch hooks of the first and second latches. In some examples, the at least one latch-engagement feature encircles the cup holder and includes a single recess configured to engage with both the first and second latches. In some examples, the at least one latch-engagement feature includes first and second recesses configured to respectively engage with the first and second latches.

In some examples, the side wall of the cup holder includes first and second gaps sized to allow a user to hold the beverage cup with first and second fingers while inserting the beverage cup into the cup holder. In some examples, the side wall of the cup holder further includes a third gap sized to allow a user to further hold the beverage cup with a third finger while inserting the beverage cup into the cup holder. In some examples, the first gap is larger than the second gap.

Some examples herein provide a retainer for use with a cup holder. The retainer includes a retaining ring; a skirt; first and second latches; and first and second hinges respectively movably coupling the first and second latches to the skirt. The retainer is couplable to the cup holder by engaging the first and second latches with at least one latch-engagement feature of the cup holder and is removable from the cup holder by disengaging the first and second latches from the at least one latch-engagement feature.

In some examples, the at least one latch-engagement feature includes at least one recess. In some examples, the first and second latches include first and second latch hooks that respectively insert into the at least one recess.

In some examples, the side wall of the cup holder includes first and second gaps sized to allow a user to hold the beverage cup with first and second fingers while inserting the beverage cup into the cup holder. In some examples, the first and second latches respectively are configured to cover the first and second gaps when the retainer is coupled to the cup holder. In some examples, the skirt includes first and second skirt extensions that respectively are configured to cover the first and second gaps when the retainer is coupled to the cup holder.

In some examples, the first and second hinges include living hinges.

Some examples herein provide an assembly for holding a beverage cup. The assembly includes a cup holder including a closed bottom, a generally cylindrical or frustoconical side wall, and an upper access opening configured to receive the beverage cup. An outer surface of the side wall of the cup holder includes a latch-engagement feature. The assembly also includes a retainer including a retaining ring, a skirt, a latch, a first hinge movably coupling the latch to the skirt, and a second hinge movably coupling the retainer to the cup holder. The latch engages the latch-engagement feature to put the retainer in a first, closed position and disengages from the latch-engagement feature to put the retainer in a second, open position.

In some examples, the outer surface of the side wall of the cup holder includes a structural feature; and the retainer includes a retainer attachment interface that engages the structural feature to couple the retainer to the cup holder. Some examples further include a third hinge between the retainer attachment interface and the skirt.

In some examples, the retainer further includes an attachment ring coupled to the skirt via the second hinge and configured to slide onto the cup holder from below.

In some examples, the latch-engagement feature includes a recess. In some examples, the recess is downward-facing. In some examples, the latch includes a latch hook that inserts into the recess. In some examples, the latch-engagement feature encircles the cup holder.

In some examples, the side wall of the cup holder includes first and second gaps sized to allow a user to hold the beverage cup with first and second fingers while inserting the beverage cup into the cup holder. In some examples, the latch covers the first gap when the retainer is in the first, closed position. In some examples, the skirt includes first and second skirt extensions that respectively cover the first and second gaps when the retainer is in the first, closed position. In some examples, the side wall of the cup holder further includes a third gap sized to allow a user to further hold the beverage cup with a third finger while inserting the beverage cup into the cup holder. In some examples, the first gap is larger than the second gap.

In some examples, the first and second hinges include living hinges.

Some examples herein provide a cup holder for holding a beverage cup. The cup holder includes a closed bottom; a generally cylindrical or frustoconical side wall; and an upper access opening configured to receive the beverage cup. An outer surface of the side wall of the cup holder includes a latch-engagement feature. The outer surface of the cup holder is configured to be coupled to a retainer. The latch-engagement feature is configured to engage a latch of the retainer.

In some examples, the outer surface of the cup holder includes a ring against which an attachment ring of the retainer is configured to be pressed, or a structural feature that engages a retainer attachment interface.

In some examples, the latch-engagement feature includes a recess. In some examples, the recess is downward-facing. In some examples, the recess is configured to receive a latch hook of the latch. In some examples, the latch-engagement feature encircles the cup holder.

In some examples, the side wall of the cup holder includes first and second gaps sized to allow a user to hold the beverage cup with first and second fingers while inserting the beverage cup into the cup holder. In some examples, the side wall of the cup holder further includes a third gap sized to allow a user to further hold the beverage cup with a third finger while inserting the beverage cup into the cup holder. In some examples, the first gap is larger than the second gap.

Some examples herein provide a retainer for use with a cup holder. The retainer includes a retaining ring; a skirt; a latch; a first hinge movably coupling the latch to the skirt; and a second hinge movably coupling the retainer to the cup holder. The latch is configured to engage a latch-engagement feature of the cup holder to put the retainer in a first, closed position and to disengage from the recess to put the retainer in a second, open position.

Some examples further include a retainer attachment interface configured to engage a structural feature of the cup holder to couple the retainer to the cup holder. Some examples further include a third hinge between the retainer attachment interface and the skirt.

Some examples further include a ring coupled to the skirt via the second hinge and configured to slide onto the cup holder from below.

In some examples, the latch includes a latch hook configured to insert into a recess of the latch-engagement feature. In some examples, the side wall of the cup holder includes first and second gaps sized to allow a user to hold the beverage cup with first and second fingers while inserting the beverage cup into the cup holder. In some examples, the latch is configured to cover the first gap when the retainer is in the first, closed position. In some examples, the skirt includes first and second skirt extensions respectively configured to cover the first and second gaps when the retainer is in the first, closed position.

In some examples, the first and second hinges include living hinges.

Some examples herein provide an assembly for holding a beverage cup. The assembly includes a cup holder including a closed bottom, a generally cylindrical or frustoconical side wall, and an upper access opening configured to receive the beverage cup. An outer surface of the side wall of the cup holder includes at least one latch-engagement feature. The assembly includes a lid including a skirt, first and second latches, and first and second hinges respectively movably coupling the first and second latches to the skirt. The lid is couplable to the cup holder by engaging the first and second latches with the at least one latch-engagement feature and is removable from the cup holder by disengaging the first and second latches from the at least one latch-engagement feature.

In some examples, the at least one latch-engagement feature includes at least one recess. In some examples, the at least one recess is downward-facing. In some examples, the first and second latches include first and second latch hooks that respectively insert into the at least one recess.

In some examples, the at least one latch-engagement feature encircles the cup holder and is configured to be engaged by both the first and second latches. In some examples, the at least one latch-engagement feature is segmented and includes first and second segments that are configured to be respectively engaged by the first and second latches.

In some examples, the side wall of the cup holder includes first and second gaps sized to allow a user to hold the beverage cup with first and second fingers while inserting the beverage cup into the cup holder. In some examples, the first and second latches respectively cover the first and second gaps when the retainer is coupled to the cup holder. In some examples, the skirt includes first and second skirt extensions that respectively cover the first and second gaps when the retainer is coupled to the cup holder. In some examples, the side wall of the cup holder further includes a third gap sized to allow a user to further hold the beverage cup with a third finger while inserting the beverage cup into the cup holder. In some examples, the first gap is larger than the second gap.

In some examples, the first and second hinges include living hinges.

Some examples herein provide a lid for use with a cup holder. The lid includes a skirt; first and second latches; and first and second hinges respectively movably coupling the first and second latches to the skirt. The lid is couplable to the cup holder by engaging the first and second latches with at least one latch-engagement feature of the cup holder and is removable from the cup holder by disengaging the first and second latches from the at least one latch-engagement feature.

In some examples, the at least one latch-engagement feature includes at least one recess, and the first and second latches include first and second latch hooks that respectively insert into the at least one recess.

In some examples, the side wall of the cup holder includes first and second gaps sized to allow a user to hold the beverage cup with first and second fingers while inserting the beverage cup into the cup holder. In some examples, the first and second latches respectively are configured to cover the first and second gaps when the lid is coupled to the cup holder. In some examples, the skirt includes first and second skirt extensions that respectively are configured to cover the first and second gaps when the lid is coupled to the cup holder.

In some examples, the first and second hinges include living hinges.

BRIEF DESCRIPTION OF DRAWINGS

FIG. 7A shows a perspective view of a cup holder with a semi-permanent attachment point for a retainer.

FIG. 7B shows a perspective view of a retainer configured to be semi-permanently attached to the cup holder of FIG. 7A.

FIG. 7C shows a perspective view of a cup holder with a retainer semi-permanently attached in the open position.

FIG. 7D shows a perspective view of a cup holder with a semi-permanent retainer, assembled with a cup and lid.

DETAILED DESCRIPTION

As will be described with reference to FIGS. 1A-1C, 2A-2B, 3A-3C, 4A-4F, 5A-5B, 6A-6D, 7A-7D, 8A-8G, 9A-9B, 10A-10B, and 11A-11C, provided herein are improved cup holders, retainers, lids, and assemblies of two or more of such elements, which may be used to securely hold a beverage cup in a user-friendly manner. For example, the present cup holders, retainers, lids, and assemblies may include hinges and/or latch-engagement features that allow a beverage cup to be conveniently secured within a cup holder and released from the cup holder with reduced risk of the retainer becoming lost or inadvertently dislodged from the cup holder. Illustratively, some examples herein provide an assembly for holding a beverage cup that includes a cup holder and a retainer. The cup holder may include a closed bottom, a generally cylindrical or frustoconical side wall, and an upper access opening configured to receive the beverage cup, wherein an outer surface of the side wall of the cup holder includes a latch-engagement feature. The retainer may include retaining ring, a skirt, a latch, and a hinge, wherein the latch is configured to engage the latch-engagement feature.

Figure 1A:
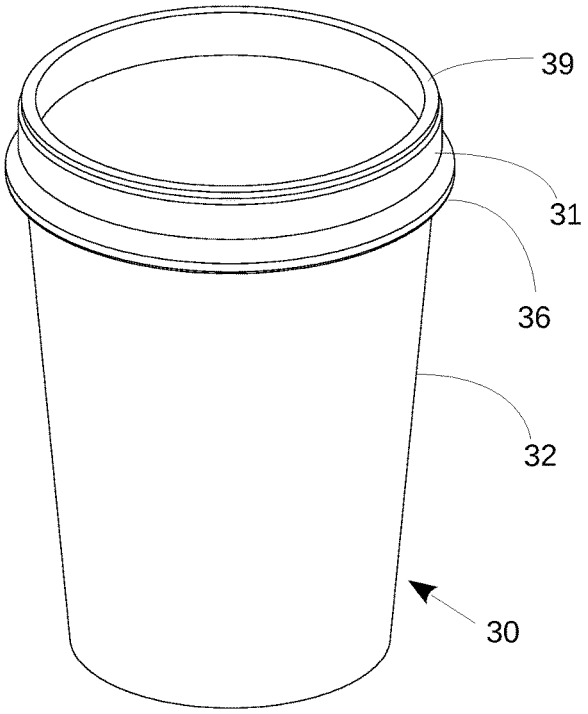
FIG. 1A shows a perspective view of a cup holder with a latch-engagement feature.
Figure 1B:
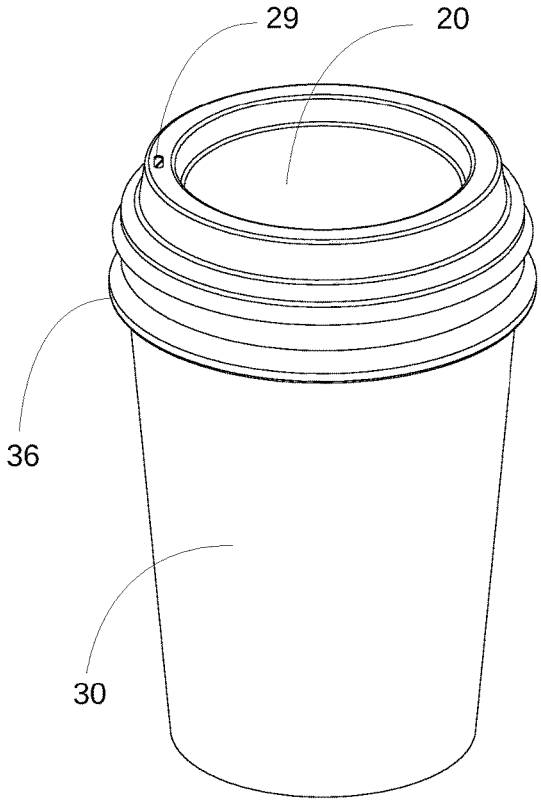
FIG. 1B shows a perspective view of the cup holder of FIG. 1A assembled with a disposable cup and lid.
Figure 1C:
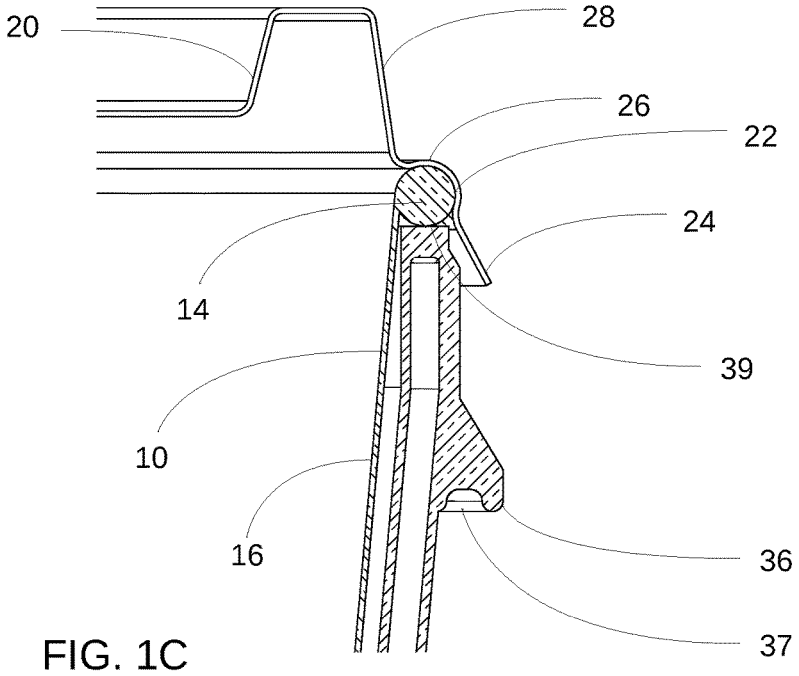
FIG. 1C shows a cross-section view of a portion of the assembly of FIG. 1B.

Illustratively, an example holder for a disposable beverage cup is illustrated in FIGS. 1A through 1C. The illustrated assembly is seen to include a conventional, disposable beverage cup 10, a conventional disposable lid 20, and a cup holder 30. Cup 10 may be made of plastic, paper, or paper coated with materials such as plastic or wax, depending on the nature of the beverage for which it is intended. The cup walls 16 take the shape of an inverted truncated cone, with generally flat and parallel top and bottom. At the upper end, the cup includes a radially-outwardly-extending peripheral bead 14, which provides structural rigidity to the circular upper opening of the cup, and provides a mating interface for a disposable lid. As illustrated in FIGS. 1B and 1C, conventional disposable lid 20 includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below peripheral groove 22, such that the skirt provides a guiding surface to assist in aligning the disposable lid for mating on bead 14 of disposable cup 10. Disposable lid 20 also includes a neck 28 leading to an elevated section containing a drinking port 29.

Cup holder 30 includes a closed bottom, generally cylindrical or frustoconical side wall, and an upper access opening configured to receive the beverage cup. Illustratively, cup holder 30 includes a wall 32 substantially in the form of a truncated inverted cone open at the top and closed at the bottom by a generally flat bottom surface. Near its top, wall 32 includes a short, substantially-cylindrical section 31 and ends in an upward-facing circular flange 39 configured to support cup 10 at the underside of peripheral bead 14. The inner diameter of upward-facing flange 39 is preferably greater than or equal to the diameter of side wall 16 of disposable beverage cup 10 at the level of the bottom of bead 14 but less than the diameter of a circle that follows the center of peripheral bead 14 around the top of cup 10. Further, the outer diameter of upward-facing flange 39 is preferably greater than the diameter of a circle that follows the center of peripheral bead 14 around the top of cup 10, but also less than the inner diameter of skirt 24 on disposable lid 20. These dimensional constraints ensure that bead 14 is able to rest securely but without interference on upward-facing flange 39 when beverage cup 10 with mating lid 20 are together inserted into cup holder 30. Alternatively, beverage cup 10 without lid 20 may be inserted into cup holder 30, with lid 20 being attached to cup 10 after insertion into cup holder 30.

According to some examples provided herein, as illustrated in FIG. 1C, cup holder 30 may be insulated to reduce or minimize heat transfer between the contents of cup 10 and the outside environment by providing a double wall and floor with either an insulating material disposed between the walls or evacuating the volume between the walls. The use of double walls in the figures of the present patent application is for illustration purposes only, and it will be understood that the system and methods described herein can equally be applied to single-walled cup holders.

According to some examples provided herein, disposable beverage cup 10 in combination with lid 20 may be retained within cup holder 30 by means of a releasable clamp. In examples such as will be described with reference to FIGS. 1A-1C, 2A-2B, 3A-3C, 4A-4F, 5A-5B, 6A-6D, 7A-7D, 8A-8G, and 11A-11C, the releasable clamp may be provided in a retainer, such as a retaining ring. In examples such as will be described with reference to FIGS. 9A-9B and 10A-10B, the releasable clamp may be provided in a lid.

Figure 2A:
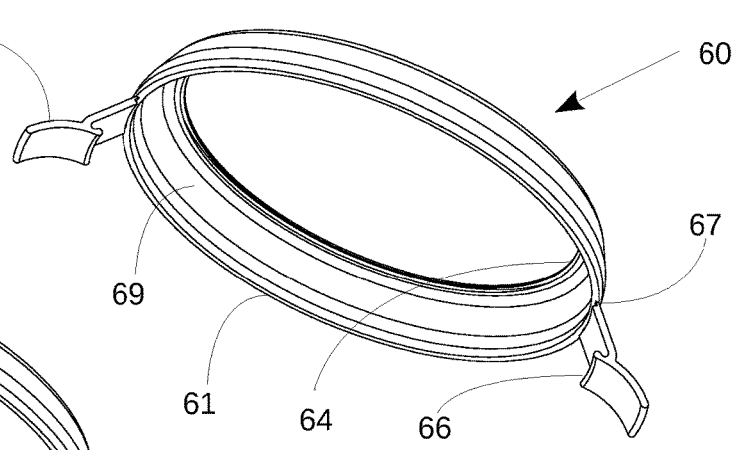
FIG. 2A shows a perspective view of a retainer with latches in the open position.
Figure 2B:
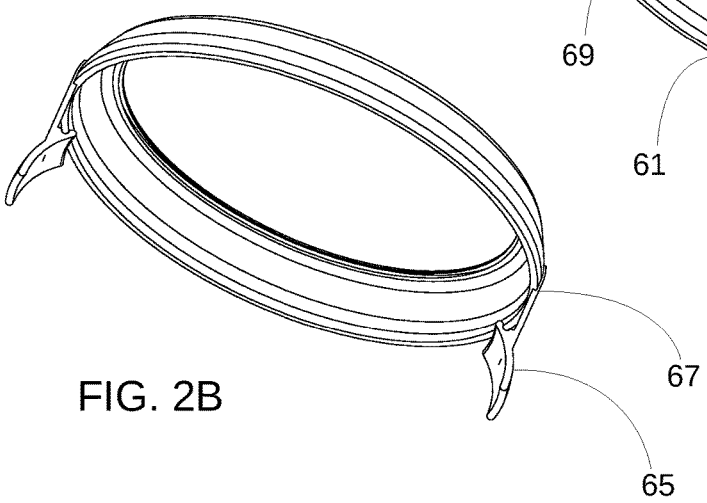
FIG. 2B shows a perspective view of a retainer with latches in the closed position.

The retainer may include a retaining ring, a skirt, first and second latches, and first and second hinges respectively movably coupling the first and second latches to the skirt. For example, as shown in FIGS. 1A through 1C, outer wall 32 of cup holder 30 includes at least one latch-engagement feature 36 optionally including at least one recess, such as a downward-facing recess 37. FIGS. 2A and 2B illustrate a releasable clamp in the form of a retainer 60 having a ring shape (and thus may be referred to herein as a "retaining ring") with hinged latches 65 that can be used to detachably secure it to cup holder 30 by engaging the latches with the at least one latch-engagement feature 36. In some examples, retainer 60 includes an inward facing circumferential lobe 64 with an inner diameter not less than the outer diameter of neck 28 of disposable lid 20, and not more than the diameter of the circular line of contact between bead 14 and upward-facing flange 39. In the example illustrated in FIGS. 2A-2B, retainer 60 further includes a skirt 61 below inward-facing lobe 64. In some examples, the inner diameter of retainer skirt 61 is at least greater than the outer diameter of skirt 24 on lid 20 in order that retainer 60 may fit over skirt 24 without interference. Latches 65 may include a latch hook 66, and may be secured to retainer 60 by hinges 67 such as, for example, living hinges, configured to allow latches to rotate between non-latching (disengaged) and latching (engaged) positions, as illustrated in FIGS. 2A and 2B, respectively.

Figure 3A:
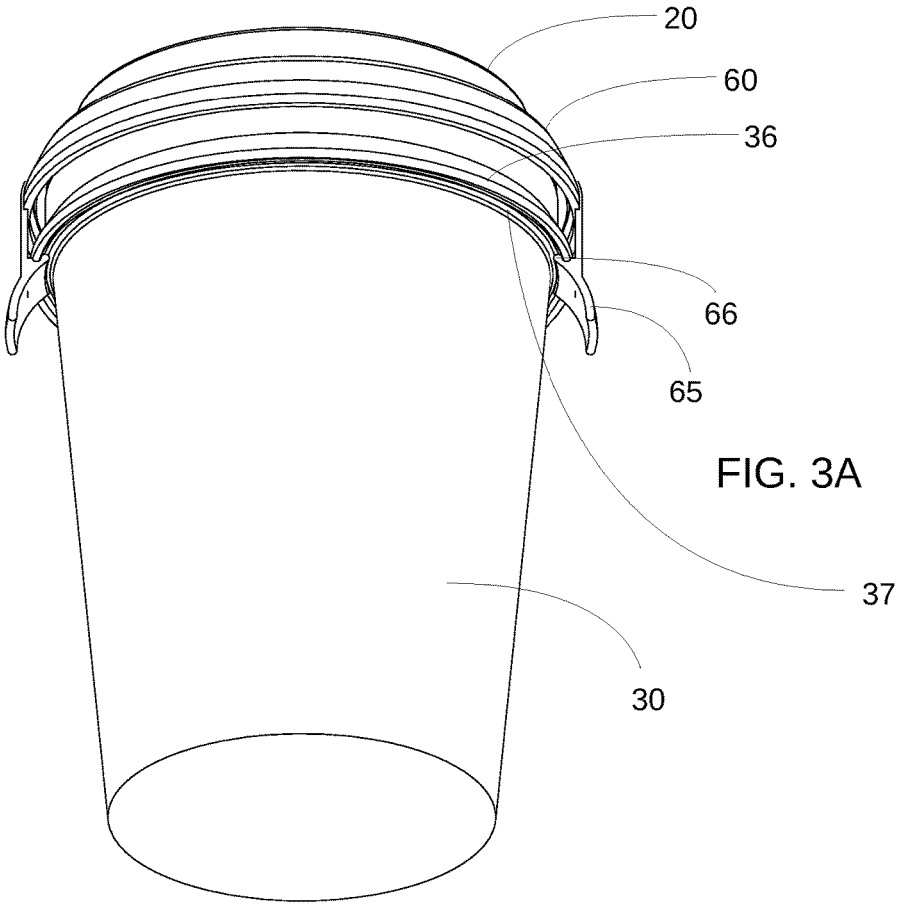
FIG. 3A shows a perspective view of the cup holder of FIG. 1A assembled with a disposable cup and lid and secured with a retainer, as seen from below.
Figures 3B, 3C:
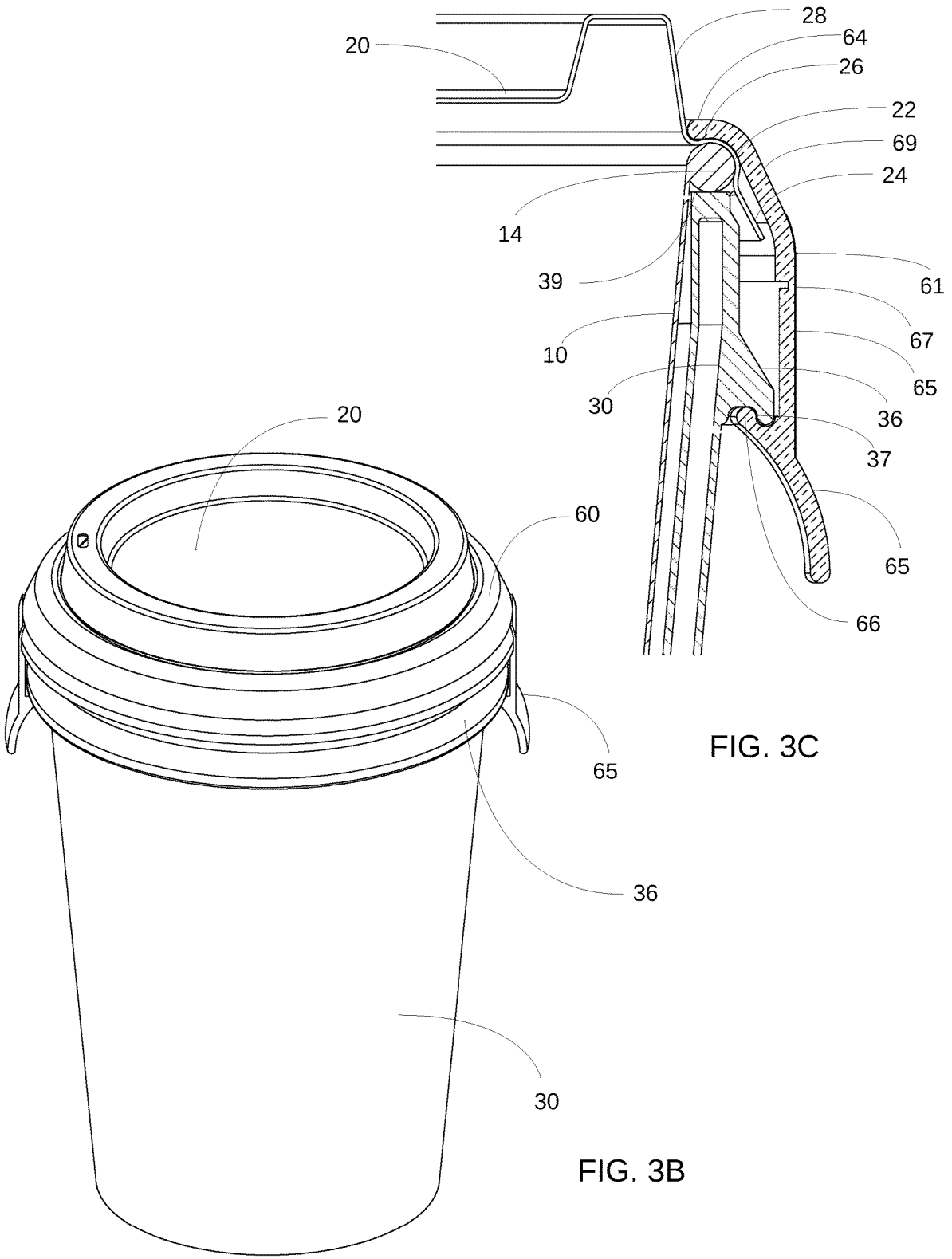
FIG. 3B shows a perspective view of the cup holder of FIG. 1A assembled with a disposable cup and lid and secured with a retainer, as seen from above.
FIG. 3C shows a cross-section view of a portion of the assembly of FIG. 3B.

The retainer 60 is couplable to the cup holder 30 by engaging the first and second latches 65 with the at least one latch engagement feature 36 and is removable from the cup holder by disengaging the first and second latches from the latch engagement feature. For example, FIGS. 3A through 3C illustrate the assembly of cup 10, lid 20, holder 30, and retainer 60. In the illustrated configuration, latch hooks 66 respectively engage with recess 37 in latch-engagement feature 36, holding retainer 60 securely on holder 30 and thereby securely containing cup 10 and lid 20 in holder 30 through the application of a downward force on shoulder 26 through bead 14 to upward-facing flange 39. In the nonlimiting example shown in FIGS. 1A through 1C, latch-engagement feature 36 is shown as completely encircling cup holder 30. The latch-engagement feature may include a single recess with which both first and second latches engage. It will be understood that a segmented latch-engagement feature (e.g., such as illustrated in FIGS. 4A-4F, 5A-5B, 6A-6D, 6A-7D, 8A-8G, 10A-10B, and 11A-11B) alternatively may be used. The segmented latch-engagement feature may include first and second recesses with which the first and second latches respectively engage. In such examples, the retainer may be oriented to ensure that the latch(es) align with usable portions of the latch-engagement feature.

According to examples such as illustrated in FIGS. 1A through 3C, upward-facing flange 39 may include an unbroken ring configured to interface with peripheral bead 14 of disposable beverage cup 10. When the flange is unbroken, as illustrated in FIG. 1A, it may be somewhat difficult to insert a beverage cup containing a liquid beverage into cup holder 30 without risk of spilling some liquid. This is because a user handling a filled beverage cup may find it easier and more secure to hold the cup by its side walls as opposed to holding the bead. While inserting a filled beverage cup into a cup holder 30 including an unbroken upward-facing flange, the user may find it necessary to hold the beverage cup by its peripheral bead while inserting the cup into cup holder 30. Further, if a filled beverage cup is covered with a disposable lid the bead is no longer accessible and insertion into cup holder 30 may require that the cup and lid combination be held by the lid, with the potential that the lid could detach from the bead and spill the contents of the cup. This is intended to be illustrated in FIG. 1B, where cup 10 with lid 20 have been inserted in holder 30, but no part of cup 10 is visible, indicating that the user may not be able to maintain contact with cup 10 while inserting the cup and lid combination into cup holder 30.

According to some examples provided herein, such as described with reference to FIGS. 4A-4F, 5A-5B, 6A-6D, 7A-7D, 8A-8F, 9A-9B, 10A-10B, and 11A-11C, the side wall and flange of the cup holder may include two or more gaps sized to allow a user to hold a beverage cup with two or more fingers while inserting the beverage cup into the cup holder. In the nonlimiting example illustrated in FIGS. 4A through 4C, a cup holder 40 includes a wall 42 substantially in the form of a truncated inverted cone open at the top and closed at the bottom by a generally flat bottom surface. Near its top, wall 42 includes a short substantially cylindrical section 41 and ends in a segmented upward-facing circular flange 49 configured to support cup 10 at the underside of peripheral bead 14. The inner diameter of upward-facing flange 49 is preferably greater than or equal to the diameter of side wall 16 of disposable beverage cup 10 at the level of the bottom of bead 14. Further, the outer diameter of upward-facing flange 49 is preferably less than the inner diameter of skirt 24 on disposable lid 20. Upward-facing flange 49 is broken into segments separated by two gaps 48 extending downward into the upper part of wall 42 of cup holder 40. Gaps 48 are sized to allow a disposable cup 10 to be grasped between two or more fingers (where the term "fingers" is understood to include the thumb) as it is being inserted into cup holder 40, and to allow the grip on cup 10 to be maintained until cup 10 is fully inserted into cup holder 40 such that bead 14 is resting stably on segmented flange 49. Gaps 48 are sized to allow finger contact with the walls of disposable beverage cup 10 until the bead rests on segmented flange 49 even when disposable lid 20 is attached to disposable beverage cup 10. This is intended to be illustrated in FIG. 4C where cup 10 with lid 20 have been inserted in holder 40 and side wall 16 of cup 10 is visible through gap 48, indicating that the user would be able to maintain contact with the cup wall throughout the insertion process. Cup holder 40 further includes a latch-engagement feature 46 on the cylindrical section 41 of wall 42. Like upward-facing flange 49, latch-engagement feature 46 is segmented to allow clearance for insertion of the cup 10 in holder 40. After cup 10 with lid 20 is fully inserted into cup holder 40, retainer 60 may be attached, as illustrated in FIG. 4F, to prevent a filled beverage cup 10 from being easily dislodged from cup holder 40.

Figure 4A:
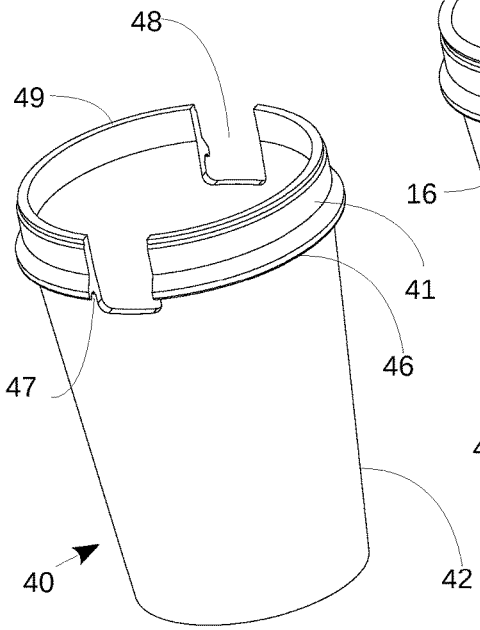
FIG. 4A shows a perspective view of a cup holder with finger-sized gaps in the upper wall, flange, and latch-retaining feature.
Figure 4B:
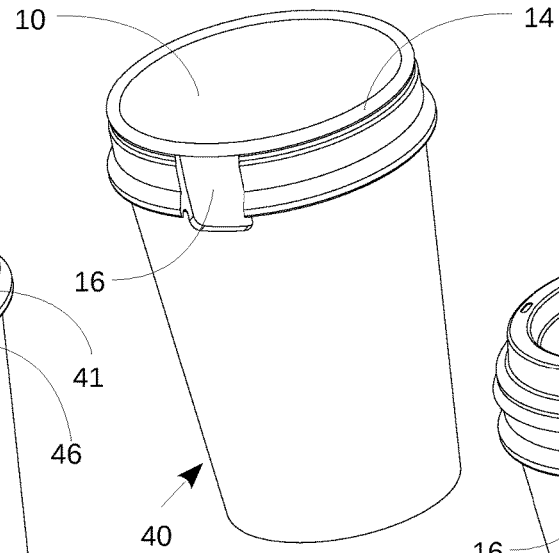
FIG. 4B shows a perspective view of the cup holder of FIG. 4A assembled with a cup.
Figure 4C:
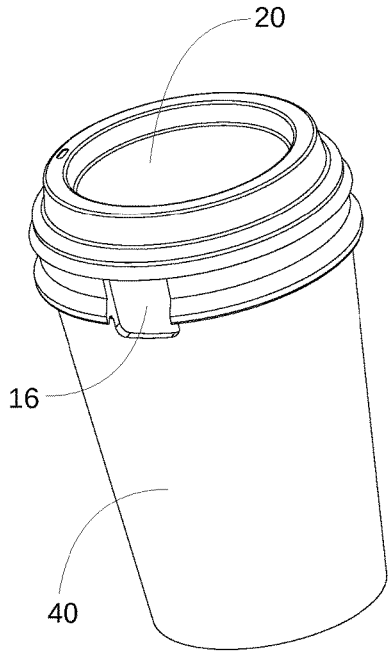
FIG. 4C shows a perspective view of the cup holder of FIG. 4A assembled with a cup and lid.
Figure 4D:
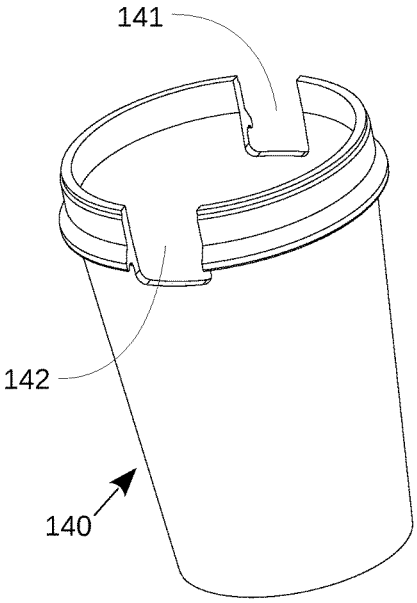
FIG. 4D shows a perspective view of a cup holder with finger-sized gaps of two different sizes.
Figure 4E:
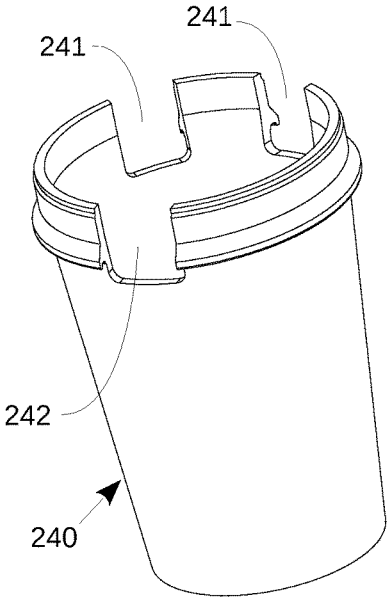
FIG. 4E shows a perspective view of a cup holder with three finger-sized gaps.
Figure 4F:
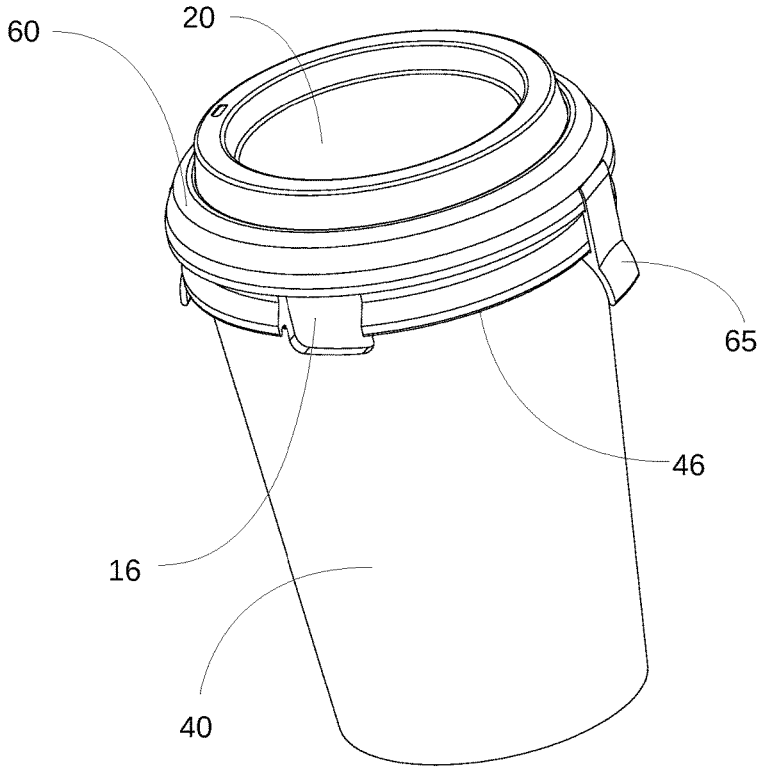
FIG. 4F shows a perspective view of the cup holder of FIG. 4A assembled with a cup, lid, and retainer.

In the example illustrated in FIG. 4A, gaps 48 may be of a uniform size. Alternatively, in the example illustrated in FIG. 4D, cup holder 140 may include two gaps 141 and 142 where one may be larger than the other to fit the thumb, which is typically larger than the other fingers. Further, in the example illustrated in FIG. 4E, cup holder 240 may include more than two gaps to facilitate more secure handling of cup 10 as it is inserted into cup holder 240. For example, gap 242 may be larger than gaps 241, where the arrangement of the gaps corresponds to preferred positions of thumb and two fingers when holding a cup from above. It will be appreciated that any examples provided herein suitably may be modified so as to include either an unbroken upper flange with no finger gaps; an upper flange and side wall which include two finger gaps; or an upper flange and side wall which include three or more finger gaps; and that any such finger gaps may be of a uniform size or may be differently sized.

Figure 5A:
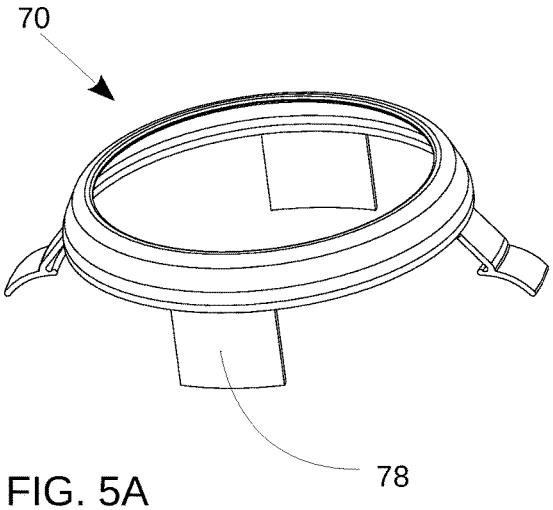
FIG. 5A shows a perspective view of retainer having skirt extensions to cover finger-sized gaps.
Figure 5B:
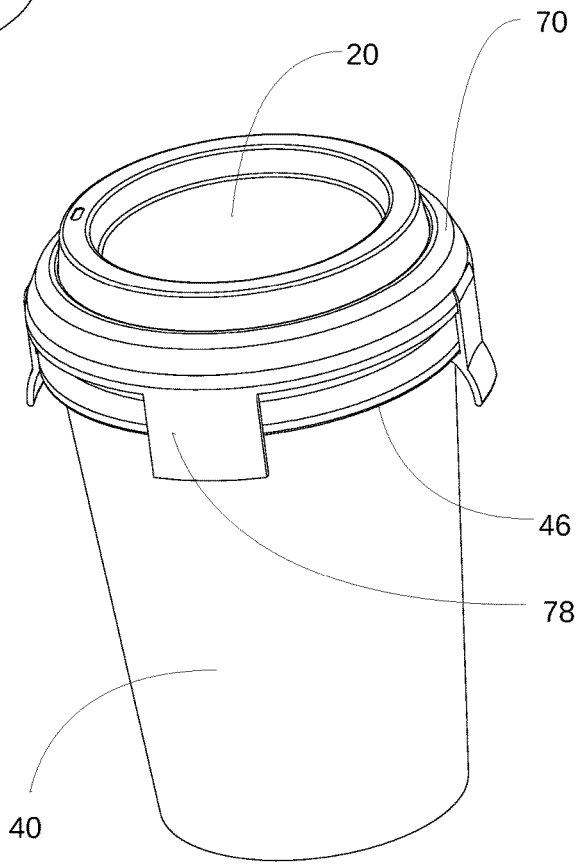
FIG. 5B shows a perspective view of the cup holder of FIG. 4A assembled with a cup, lid, and the retainer of FIG. 5A.
Figure 6A:
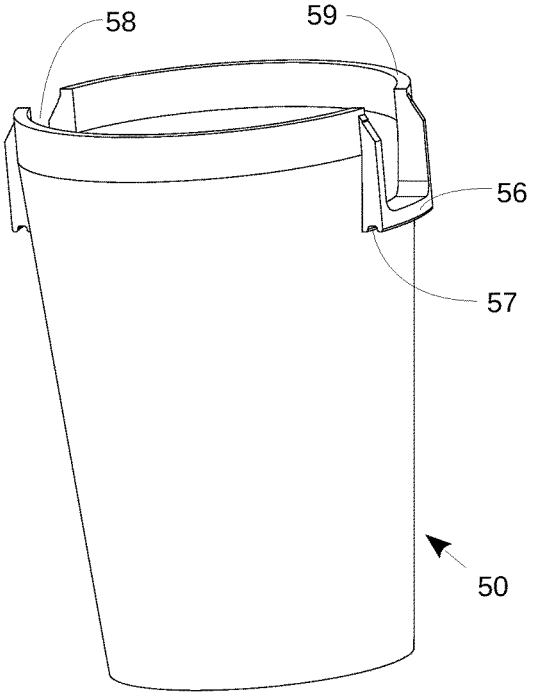
FIG. 6A shows a perspective view of a cup holder with finger-sized gaps in the upper wall and flange, and a latch-retaining feature below the gaps.
Figure 6B:
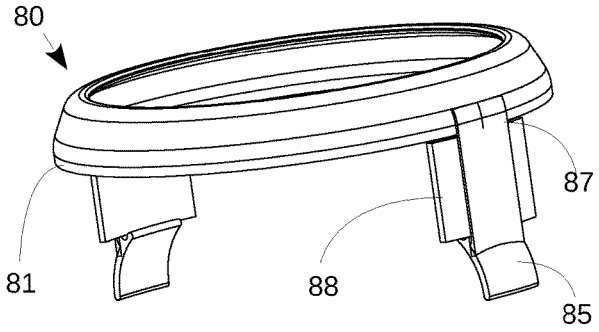
FIG. 6B shows a perspective view of a retainer configured to attach to the cup holder of FIG. 6A.
Figure 6C:
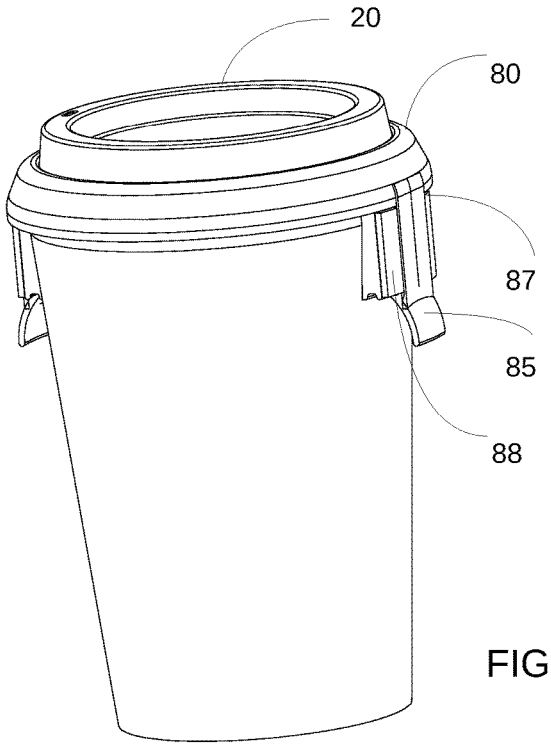
FIG. 6C shows a perspective view of the cup holder of FIG. 6A assembled with a cup, lid, and the retainer of FIG. 6B.
Figure 6D:
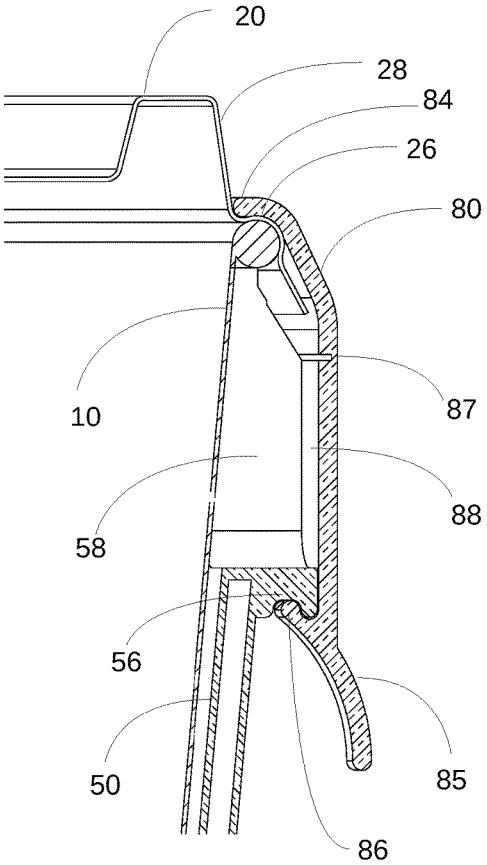
FIG. 6D shows a cross-section view of a portion of the cup holder of FIG. 6C.

In some examples, the skirt of the retainer may partially or fully cover the two or more gaps, e.g., in a manner such as illustrated in FIGS. 4F, 5A-5B, and 11A-11C. According to examples such as illustrated in FIGS. 5A and 5B, retainer 70 may further include skirt extensions 78 configured to substantially cover finger-sized gaps 48 when retainer 70 is properly aligned and secured to cup holder 40. By covering gaps 48, skirt extensions 78 help to reduce or minimize heat transfer between the contents of cup 10 and the outside environment. In other examples such as will be described with reference to FIGS. 6A-6D, 7A-7D, and 8A-8G, the latch(es) may partially or fully cover the two or more gaps when the retainer is coupled to the cup holder. In still other examples such as will be described with reference to FIGS. 9A-9B and 10A-10B, the latch(es) may partially or fully cover the two or more gaps when the lid is coupled to the cup holder.

According to examples such as illustrated in FIGS. 6A through 6D, a cup holder 50 includes a segmented upward-facing flange 59 with segments separated by finger-sized gaps 58 in side wall 52 to facilitate insertion of cup 10 in holder 50. Finger-sided gaps 58 are bounded on the bottom by a protruding latch-engagement feature 56 including a recess 57 configured to engage with a latch hook. Retainer 80 includes an inward facing circumferential lobe 84 with an inner diameter not less than the outer diameter of neck 28 of disposable lid 20, and not more than the diameter of the circular line of contact between bead 14 and upward-facing flange 39. Retainer 80 further includes a downward-extending skirt 81 below inward-facing lobe 84. The inner diameter of retainer skirt 81 is at least greater than the outer diameter of skirt 24 on lid 20 in order that retainer 80 may fit over skirt 24 without interference. Retainer 80 further includes latches 85, each including a latch hook 86. Latches 85 are attached to retainer 80 by hinges 87 such as, for example, living hinges, configured to allow latches to rotate between non-latching and latching positions. Latches 85 further include covers 88 configured to cover finger-sized gaps 58 when retainer 80 is installed on cup holder 50 and latches 85 are engaged with latch-engagement features 56.

In the examples illustrated in FIGS. 2A through 6D, the retainer may be completely separated from the cup holder in order to insert a cup into the holder. This presents an opportunity for the retainer to become lost, and it may be preferable to have a retainer that can be permanently or semi-permanently attached to the cup holder while still allowing it to open sufficiently to enable insertion of a cup and lid into the cup holder. In examples such as will be described with reference to FIGS. 7A-7D, 8A-8G, and 11A-11C, an assembly for holding a beverage cup may include a cup holder such as described elsewhere herein, and a retainer including a retaining ring, a latch, a first hinge movably coupling the latch to the retaining ring, and a second hinge movably coupling the retaining ring to the cup holder. The latch may engage the latch engagement feature to put the retainer in a first, closed position and may disengage the latch engagement feature to put the retainer in a second, open position.

In examples such as illustrated in FIGS. 7A through 7D, cup holder 370 includes a retainer attachment fixture 372 with a snap hook recess 374 that provides a secure but detachable fit for retainer snap attachment 384 on retainer 380 when retainer snap attachment 384 is pressed into fixture 372 (structural feature) as illustrated in FIG. 7C. In this configuration, retainer 380 is semi-permanently attached to cup holder 370 in the sense that it will not fall out of its own accord, but may be removed by forcibly detaching snap attachment 384 from fixture 372. Retainer 380 also includes latch 385 with latch hook 386, gap covers 381, and three hinges, for example, living hinges 382 that allow the various parts of retainer 380 to rotate relative to one another. In FIG. 7C, retainer 380 is in the open position allowing easy insertion of a cup and lid into holder 370. After cup and lid 20 have been inserted into holder 370, retainer 380 may be rotated about its hinges to a closed position, as illustrated in FIG. 7D, and latch 385 engages with latch-engagement feature 373 on cup holder 370 to secure retainer 380 in the closed position, thereby securing cup and lid in holder 370.

Figure 8A:
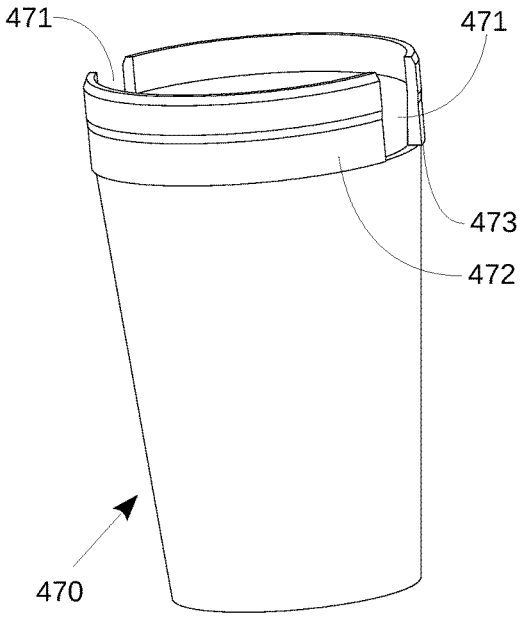
FIG. 8A shows a perspective view of a cup holder with a low-profile attachment for a retainer.
Figure 8B:
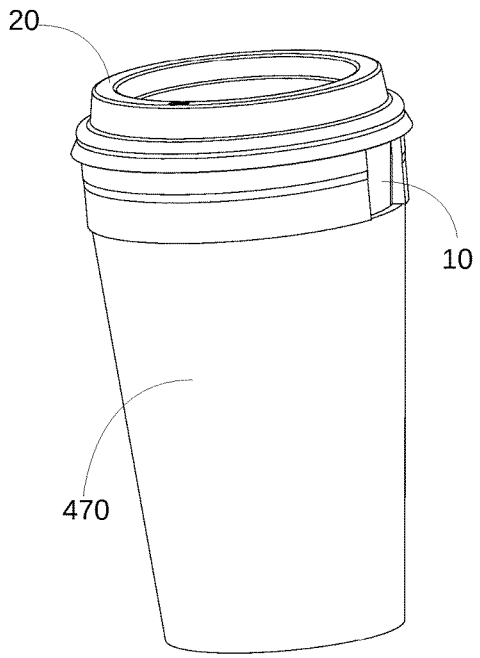
FIG. 8B shows a perspective view of the cup holder of FIG. 8A assembled with a cup and lid.
Figure 8C:
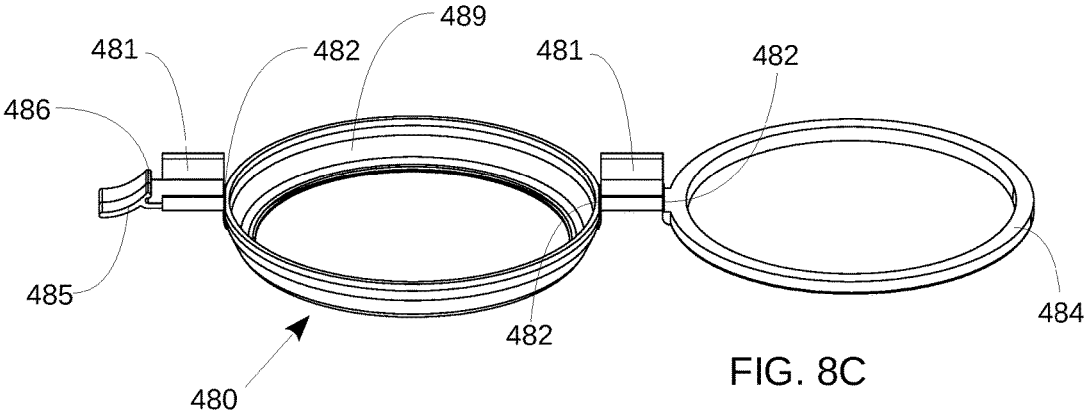
FIG. 8C shows a perspective view of a retainer configured to attach to the cup holder of FIG. 8A, as seen from above.
Figure 8D:
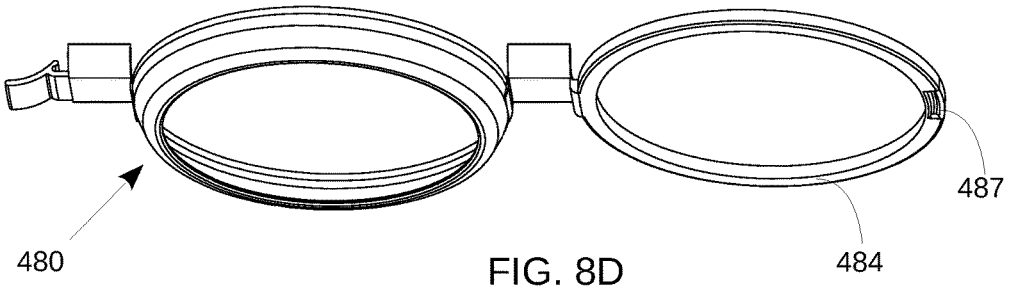
FIG. 8D shows a perspective view of the retainer of FIG. 8C, as seen from below.
Figure 8E:
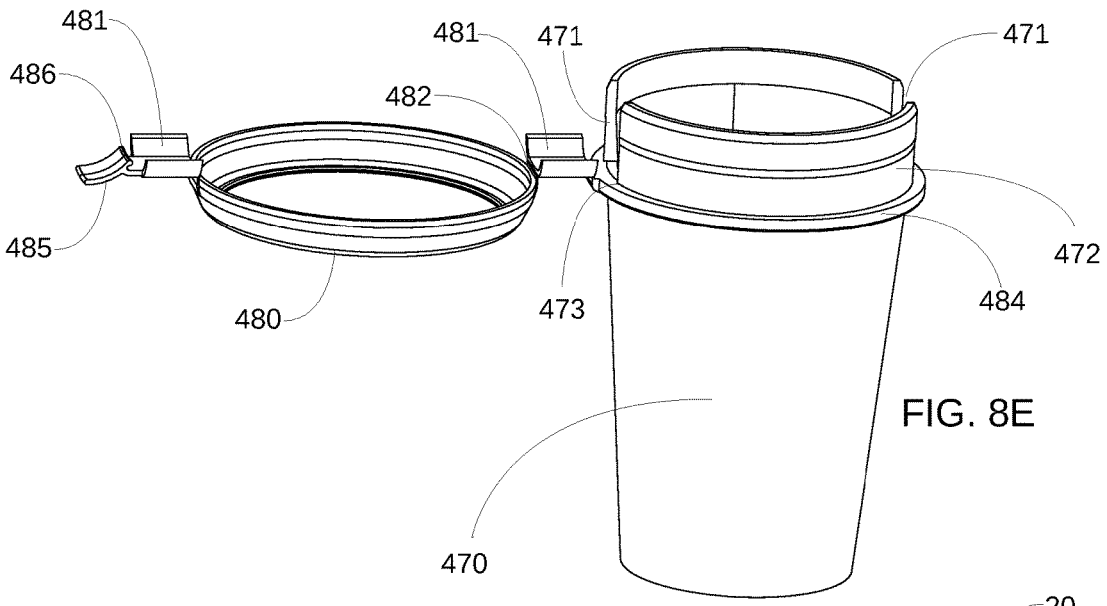
FIG. 8E shows a perspective view of the retainer of FIG. 8C assembled with the cup holder of FIG. 8A.
Figure 8F:
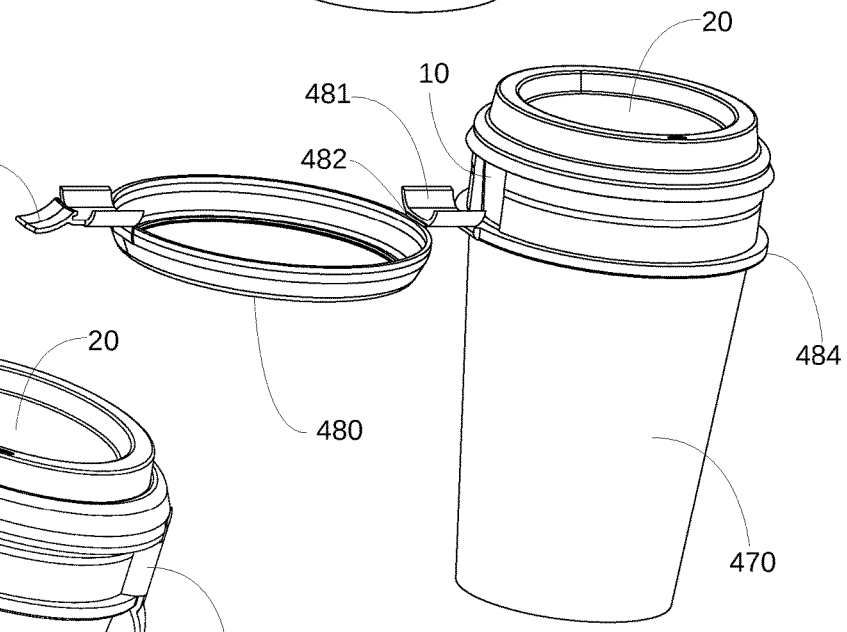
FIG. 8F shows a perspective view of the assembly of FIG. 8E further assembled with a cup and lid, with the retainer in the open position.
Figure 8G:
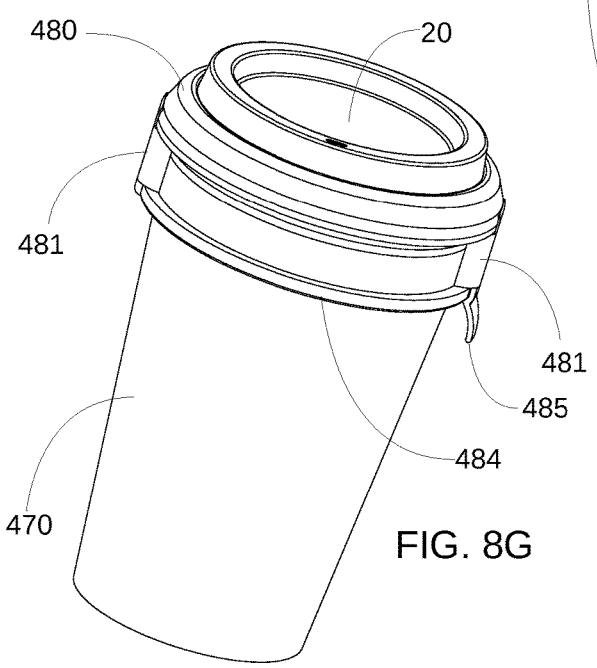
FIG. 8G shows a perspective view of the assembly of FIG. 8E further assembled with a cup and lid, with the retainer in the latched position.

Some users may prefer to use a cup holder without the retainer, may prefer a cup holder with cleaner lines, and/or may prefer not to have retainer attachment fixture 372 and/or latch-engagement feature 373 protruding from the side walls of the cup holder. In examples such as illustrated in FIGS. 8A through 8G, cup holder 470 includes a small step 473 in the diameter of side wall 472. Holder 470 may be used without a retainer as illustrated in FIG. 8B, where cup 10 with lid 20 have been inserted in holder 470. However, holder 470 may also be used with a retainer. Retainer 480 includes an attachment ring 484 configured to slide onto holder 470 from below, and sized to fit tightly around cup holder 470 just below step 473. Retainer 480 further includes retaining ring 489, latch 485 with latch hook 486, gap covers 481, and three hinges, for example, living hinges 482 that allow the various parts of retainer 480 to rotate relative to one another. Attachment ring 484 further includes a latch-engagement feature 487 on at least some portion of its downward face. In FIG. 8E, retainer 480 is semi permanently attached to holder 470, with retainer 480 in the open position, allowing easy insertion of a cup and lid into holder 470. After cup 10 and lid 20 have been inserted into holder 470 as illustrated in FIG. 8F, retainer 480 may be rotated about its hinges to a closed position, as illustrated in FIG. 8G, and latch 485 engages with latch-engagement feature 487 on the downward facing surface of attachment ring 484 to secure retainer 480 in the closed position, thereby securing cup 10 and lid 20 in holder 470.

In examples such as illustrated in FIGS. 9A through 10B, a beverage cup 10 is held within beverage cup holder 50 by means of a modified disposable beverage cup lid 90. A conventional disposable beverage cup 10 includes a radially-outwardly-extending peripheral bead 14, which provides a mating interface for a disposable lid 20 as illustrated, for example, in FIGS. 1B and 1C. Also illustrated in FIGS. 1B and 1C is a conventional disposable lid 20, which includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below circumferential groove 22, such that the skirt provides a guiding surface to assist in aligning the disposable lid for mating on bead 14 of disposable cup 10.

Figure 9A:
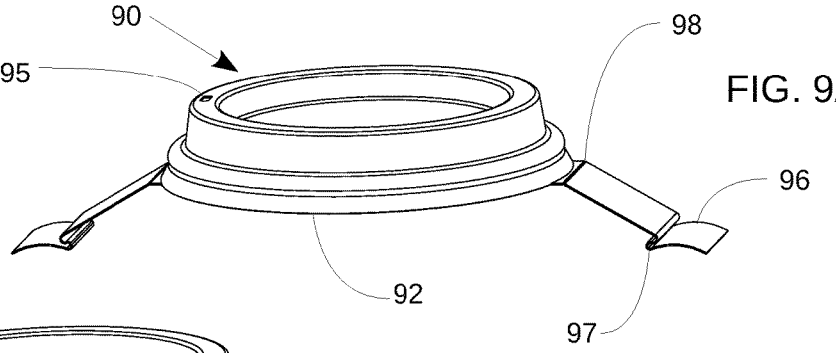
FIG. 9A shows a perspective view of a disposable lid with latches in the open position.
Figure 9B:
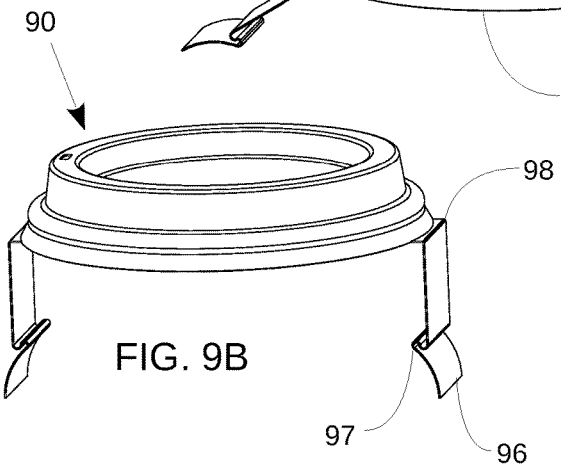
FIG. 9B shows a perspective view of a disposable lid with latches in the closed position.
Figure 10A:
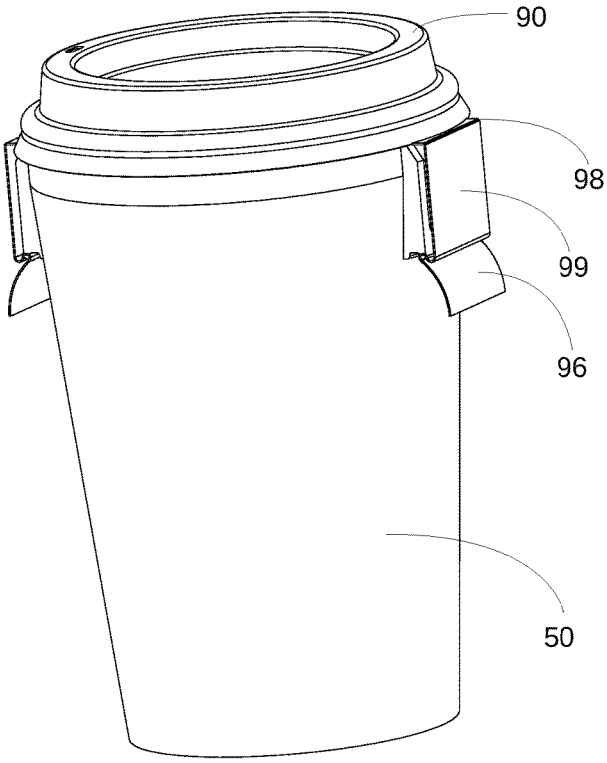
FIG. 10A shows a perspective view of the cup holder of FIG. 6A assembled with a cup and a lid including integral latches.
Figure 10B:
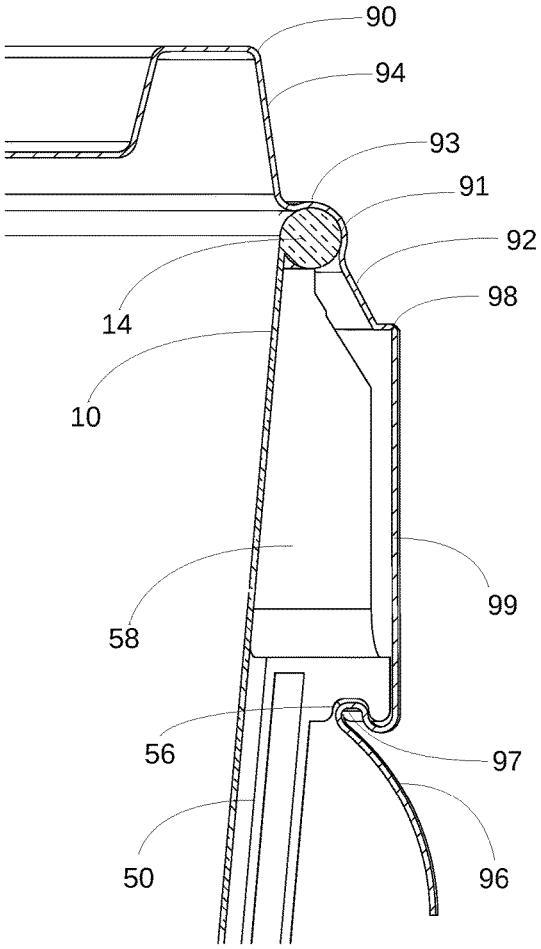
FIG. 10B shows a cross-section view of a portion of the cup holder, cup, and lid of FIG. 10A.

In examples such as illustrated in FIGS. 9A through 10B, a disposable beverage cup lid 90 includes a radially-inwardly-opening circumferential groove 91 configured to mate through a snap fit with peripheral bead 14 of disposable cup 10, a shoulder 93 that rests on the top of peripheral bead 14 when lid 90 is properly mated with disposable cup 10, a peripheral skirt 92 below circumferential groove 91, and a neck 94, on top of which there is a drinking port 95, all similar to conventional disposable lid 20. Disposable lid 90 further includes latches 96 connected to skirt 92 by hinges 98 that allow latches 96 to rotate between latched and unlatched positions, as illustrated in FIGS. 9A and 9B. Latches 96 further include latch hooks 97 and may include covers 99. FIGS. 10A and 10B illustrate the use of modified disposable lid 90 to secure cup 10 in holder 50. The user may attach lid 90 to cup 10 before inserting cup 10 in holder 50 or, alternatively, the user may insert cup 10 in holder 50 before attaching lid 90 to cup 10. In either case, once cup 10, lid 90 and holder 50 are assembled, user may rotate latches 96 to engage latch hooks 97 with latch-engagement features 56. When latch hooks are properly engaged covers 99, if present, may substantially cover finger-sized gaps 58 to reduce heat flow.

Figure 11A:
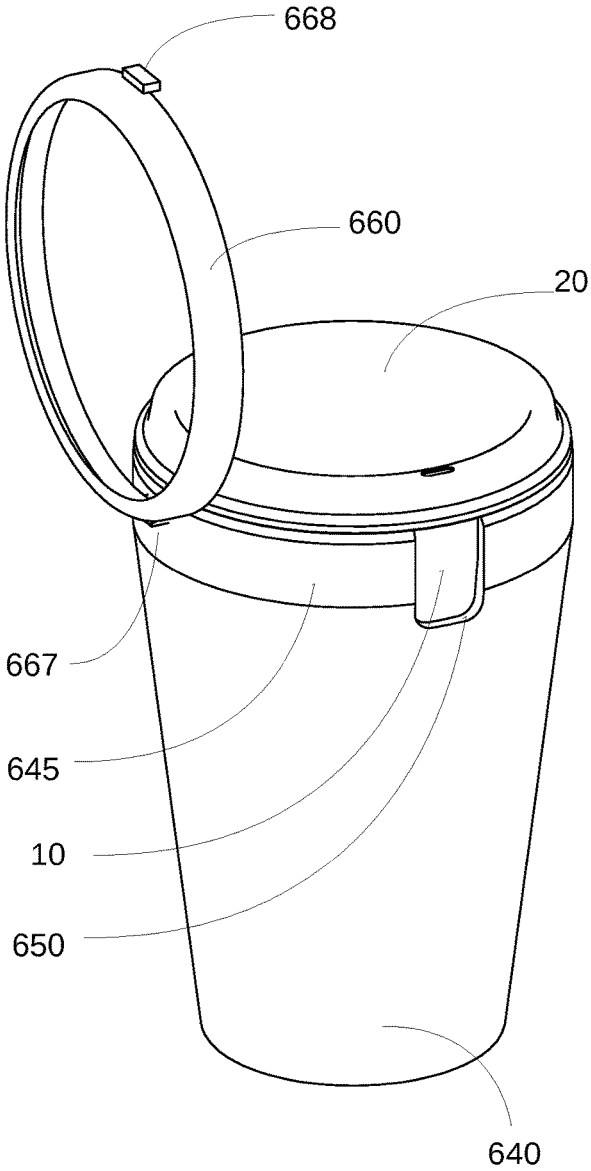
FIG. 11A shows a perspective view of an insulating cup holder containing a disposable cup and lid with a hinged retainer in the open position.
Figure 11B:
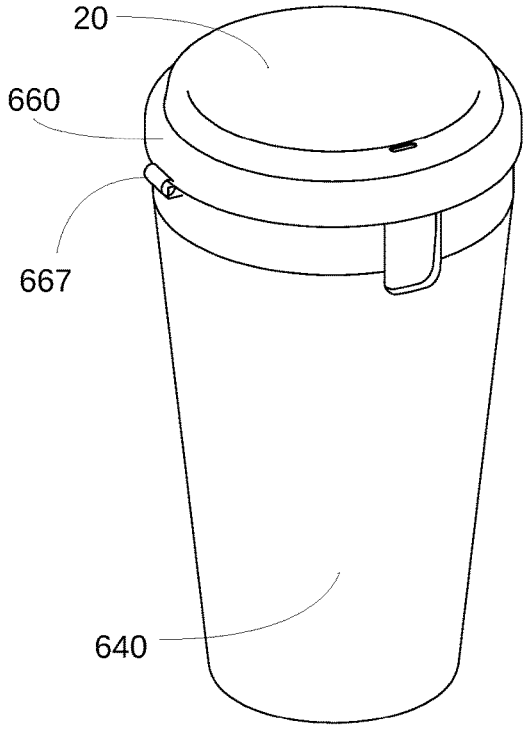
FIG. 11B shows a perspective view of an insulating cup holder containing a disposable cup and lid with a hinged retainer in the locked position, seen from the hinge side.
Figure 11C:
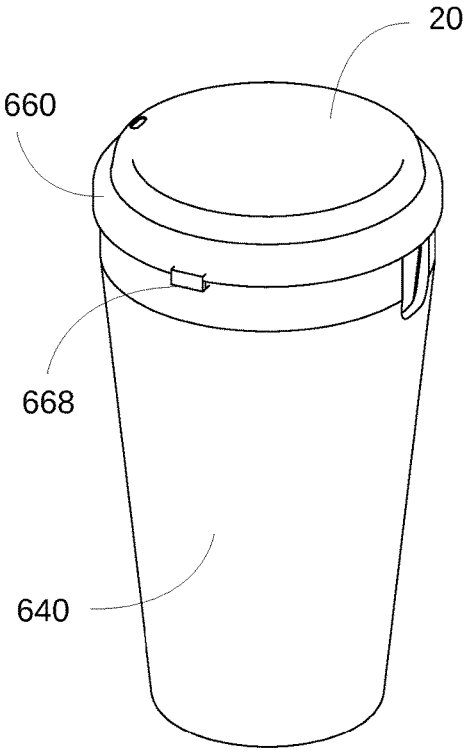
FIG. 11C shows a perspective view of an insulating cup holder containing a disposable cup and lid with a hinged retainer in the locked position, seen from the latch side.

Other examples may include other suitable means for securing a beverage cup within the cup holder without a separable retainer. For example, in configurations such as illustrated in FIGS. 11A, 11B, and 11C, retainer 660 is attached to insulating cup holder 640 by means of hinge 667 mounted on cup-holder wall 645, which allows retainer 660 to be rotated up and away from the top of cup holder 640 to allow insertion of a beverage cup 10 (visible through finger-sized slot 650) with an attached lid 20 into cup holder 640. After the beverage cup is inserted, retainer 660 may be rotated on hinge 667 to a position where it will hold cup and lid 20 in cup holder 640. Retainer 660 may be secured in this position by means of latch 668. Cup holder 640 optionally may include two or more finger sized gaps 650 in a manner such as described elsewhere herein.

The various components described herein can be combined to produce an insulating cup holder that will provide a secure support for a disposable beverage cup with a lid, provide a method for simple and secure insertion of a disposable beverage cup with or without a lid into the beverage cup holder, provide a means for maintaining the beverage in the cup at or near a preferred temperature, and provide a means for reducing or minimizing the potential for spilling a beverage contained in the beverage cup. It will be readily understood by practitioners in the art that the components of the various examples as described above may be combined in a variety of configurations, and that not all of the features of the present invention need be combined in in any single example provided herein. It will further be understood that the insulating beverage cup holder may be manufactured using any of a variety of materials including, for example, plastics and metals, within the intent of this invention. While the intent of this invention is to provide a means for securely holding a conventional disposable beverage cup with a lid, and controlling heat flow to and from a beverage contained in the cup, it will further be understood that the invention may be used with a non-disposable beverage cup and/or lid fabricated in the shape of a conventional disposable beverage cup and/or lid but fabricated from more durable and/or washable materials, for example, plastics and metals, within the intent of this invention.

This invention has been described in its currently contemplated best embodiment, and it is clear that it is susceptible to numerous modifications, modes, and embodiments within the ability of those skilled in the art and without the exercise of the inventive faculty. Accordingly, the scope of this invention is defined by the scope of the following claims.

The invention claimed is:

1. An assembly for holding a beverage cup, the assembly comprising:

a cup holder comprising a closed bottom, a generally cylindrical or frustoconical side wall comprising an inner surface and an outer surface, first and second finger gaps sized to allow a user to hold the beverage cup with first and second fingers while inserting the beverage cup into the cup holder, and an upper access opening configured to receive the beverage cup, wherein the outer surface of the side wall of the cup holder comprises a latch-engagement feature; and a retainer comprising a retaining ring, a skirt, a cover, a first latch, and a hinge, wherein the first latch is configured to engage the latch-engagement feature such that the skirt is outside of a portion of the outer surface of the side wall and the cover at least partially covers the first and second finger gaps.

2. The assembly of claim 1, wherein the side wall of the cup holder comprises an upward facing flange configured to support a peripheral bead.

3. The assembly of claim 1, wherein the retainer is entirely removable from the cup holder, and reattachable to the cup holder using the first latch and the latch-engagement feature.

4. The assembly of claim 1, wherein the retainer further includes a second latch configured to engage the latch-engagement feature.

5. The assembly of claim 4, wherein the latch-engagement feature includes a first recess that engages the first latch, and a second recess that engages the second latch.

6. The assembly of claim 4, wherein the latch-engagement features at least partially encircles the outer surface of the side wall.

* * * * *